US005604717A

United States Patent [19]

Wang

[11] Patent Number: 5,604,717

[45] Date of Patent: Feb. 18, 1997

[54] EDUCATIONAL CLOCK ASSEMBLY

[76] Inventor: I-Hwa Wang, No. 16, Kuo-Tai Lane, Sec. 2, Chang-Pin Rd., Pei-Tun Dist., Taichung City, Taiwan

[21] Appl. No.: 545,299

[22] Filed: Oct. 19, 1995

[51] Int. Cl.[6] ..... G04B 19/00

[52] U.S. Cl. ..... 368/223; 368/232; 434/304

[58] Field of Search ..... 434/304; 368/228, 368/223, 73

[56] References Cited

U.S. PATENT DOCUMENTS

| | | | |
|---|---|---|---|
| 4,361,328 | 11/1982 | Stein et al. | 434/304 |
| 4,629,431 | 12/1986 | Sanders | 434/304 |
| 4,731,025 | 3/1988 | Taylor | 434/304 |
| 4,993,006 | 2/1991 | Oshima et al. | 368/231 |
| 5,044,961 | 9/1991 | Bruskewitz | 368/45 |
| 5,105,397 | 4/1992 | Whitney | 368/80 |

*Primary Examiner*—Bernard Roskoski

*Attorney, Agent, or Firm*—Skjerven Morrill MacPherson Franklin & Friel; Alan H. MacPherson; Thomas S. MacDonald

[57] ABSTRACT

An educational clock assembly includes a clock mechanism, a circular face plate, and a fastening ring. The circular face plate is formed of a plurality of modular pieces and has a central receiving hole into which the clock mechanism is press-fitted, a plurality of first grooves which are spaced angularly and equally on the circumference of the face plate. Each of the first grooves has a hour-piece which engages detachably in the first groove and which bears a hour numeral. The fastening ring engages around the circumference of the face plate in order to bind the modular pieces together. The inner periphery of the fastening ring has a plurality of second grooves. Each of the second grooves is aligned radially with a corresponding one the first grooves of the face plate and has a minute-piece which engages detachably in the second groove and which bears a minute numeral.

2 Claims, 4 Drawing Sheets

EDUCATIONAL CLOCK ASSEMBLY

BACKGROUND OF THE INVENTION

1. Field of the Invention

This invention relates to a clock assembly, more particularly to an educational clock assembly.

2. Description of the Related Art

Usually, wooden frames are provided around conventional clocks in order to decorate the same. Such a wood frame has a receiving hole adapted to engage frictionally the conventional clock. However, forming the receiving hole by means of cutting the wooden frame is difficult. In addition, the conventional clock is liable to be damaged when the wooden frame is impacted or stricken. To overcome these problems, a clock assembly has been proposed, as shown in FIG. 1. The clock assembly comprises a clock mechanism 10, a frame body 20 and a dial plate 30. The clock mechanism 10 includes a rectangular casing 101 and a spindle 11 which has a screw nut 12, a hour hand 13 and a minute hand 14 mounted thereto in a conventional manner. The frame body 20 is made of a plastic foam material such as ethylene/vinyl acetate and is formed with a rectangular central hole 21. The size of the central hole 21 is slightly smaller than that of the casing 101 of the clock mechanism 10 so that the casing 101 can be engage firmly within the central hole 21. A mounting hole 22 may be provided in the upper portion of the frame body 20. The dial plate 30 has a plurality of clock numerals and the corresponding graduations. The spindle 11 of the clock mechanism 10 passes through a through hole 31 of the face plate 30 in order to secure the dial plate 30 to the front side of the frame body 20. Although the clock assembly can overcome the drawbacks in associated with the conventional clock, it can only be used for measuring time.

SUMMARY OF THE INVENTION

It is therefore a main object of this invention to provide an educational clock assembly which can be employed to help children to learn interrelated concepts of time measurement and to increase the children's assembling ability.

Accordingly, the educational clock assembly of the present invention comprises a clock mechanism, a circular face plate, and a fastening ring.

The circular face plate is formed of a plurality of modular pieces and has a central receiving hole into which the clock mechanism is press-fitted, a plurality of first grooves which are spaced angularly and equally on the circumference of the face plate. Each of the first grooves has a hour-piece which engages detachably therein and which bears a hour numeral.

The fastening ring engages around the circumference of the face plate in order to bind the modular pieces together. The inner periphery of the fastening ring has a plurality of second grooves. Each of the second grooves is aligned radially with a corresponding one the first grooves of the face plate and has a minute-piece which engages detachably therein and which bears a minute numeral.

In the preferred embodiment, each of the first and second grooves is formed of a bore for receiving the respective one of the hour-pieces and minute-pieces and a reduced slot connected to the bore. The slot of each of the first grooves is aligned and communicated with a corresponding one of the slots of the second grooves. Each of the hour-pieces has a connecting piece which is connected to the corresponding one of the minute-pieces and which is inserted into the slots of the first and second grooves in order to enhance the engaging force of the face plate and the fastening ring. The hour numeral of each of the hour-pieces corresponds to the minute numeral of the corresponding one of the minute-pieces.

Preferably, the outer periphery of the fastening ring has a plurality of notches formed therein and spaced equally from one another. A fix ring has an inner periphery that engages around the outer periphery of the fastening ring and that has a plurality of projections extending radially and inwardly therefrom such that each of the projections of the fix ring engages frictionally a respective one of the notches the fastening ring.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
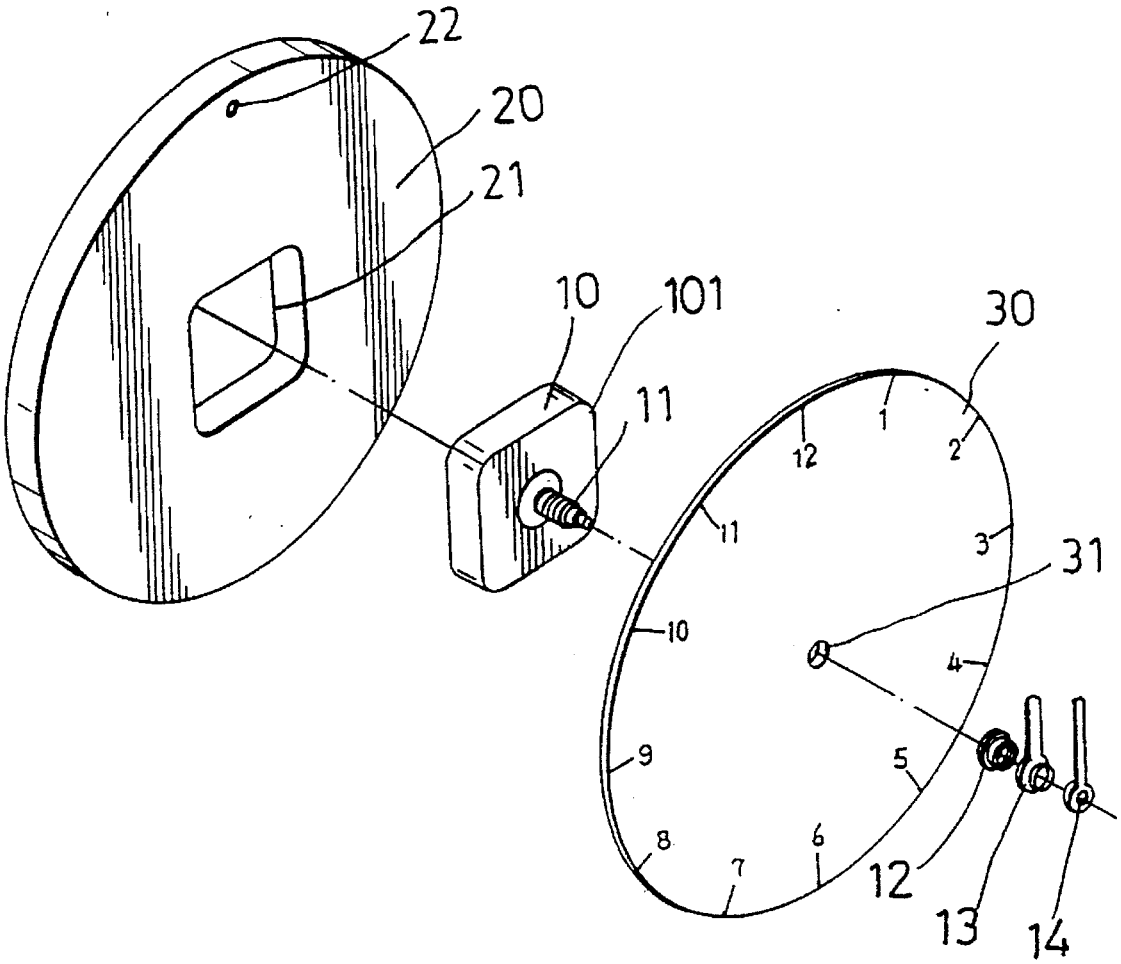
FIG. 1 PRIOR ART
FIG. 1 is an exploded view of a conventional clock assembly.
Figure 2:
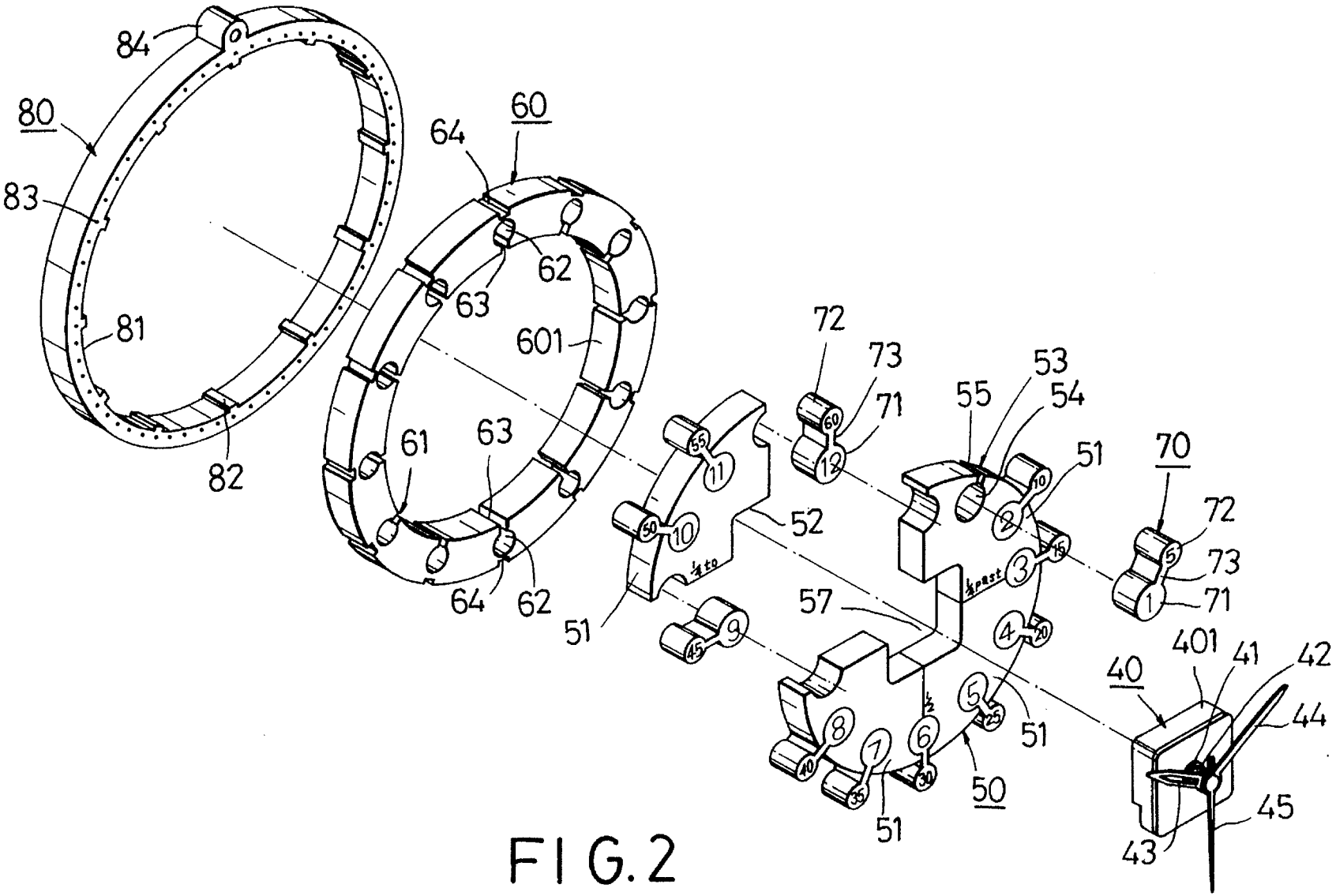
FIG. 2 is an exploded view of a preferred embodiment of an educational clock assembly of the present invention.

Referring to FIG. 2, a preferred embodiment of an educational clock assembly of the present invention is shown to comprise a clock mechanism 40, a circular face plate 50, a plurality of numeral pieces 70, a fastening ring 60, and a fix ring 80. The face plate 50 engages around the clock mechanism 40 and the fastening ring 80 engages around the outer periphery of the face plate 50. The numeral pieces 70 are mounted between face plate 50 and the fastening ring 60. The fix ring 80 is disposed around the fastening ring 60. The face plate 50, the fastening ring 60, the numeral pieces 70, and the fix ring 80 are made of a plastic foam material such as ethylene/vinyl acetate, in order to engage frictionally and firmly one another by means of the resiliency of the plastic foam material.

The clock mechanism 40 is similar to that of the conventional clock assembly and includes a rectangular casing 401, a spindle 41, a locking nut 42 which affixes a hour hand 43, a minute 44 and a second hand 45 to the spindle 41 as is known in the art.

Figure 3:
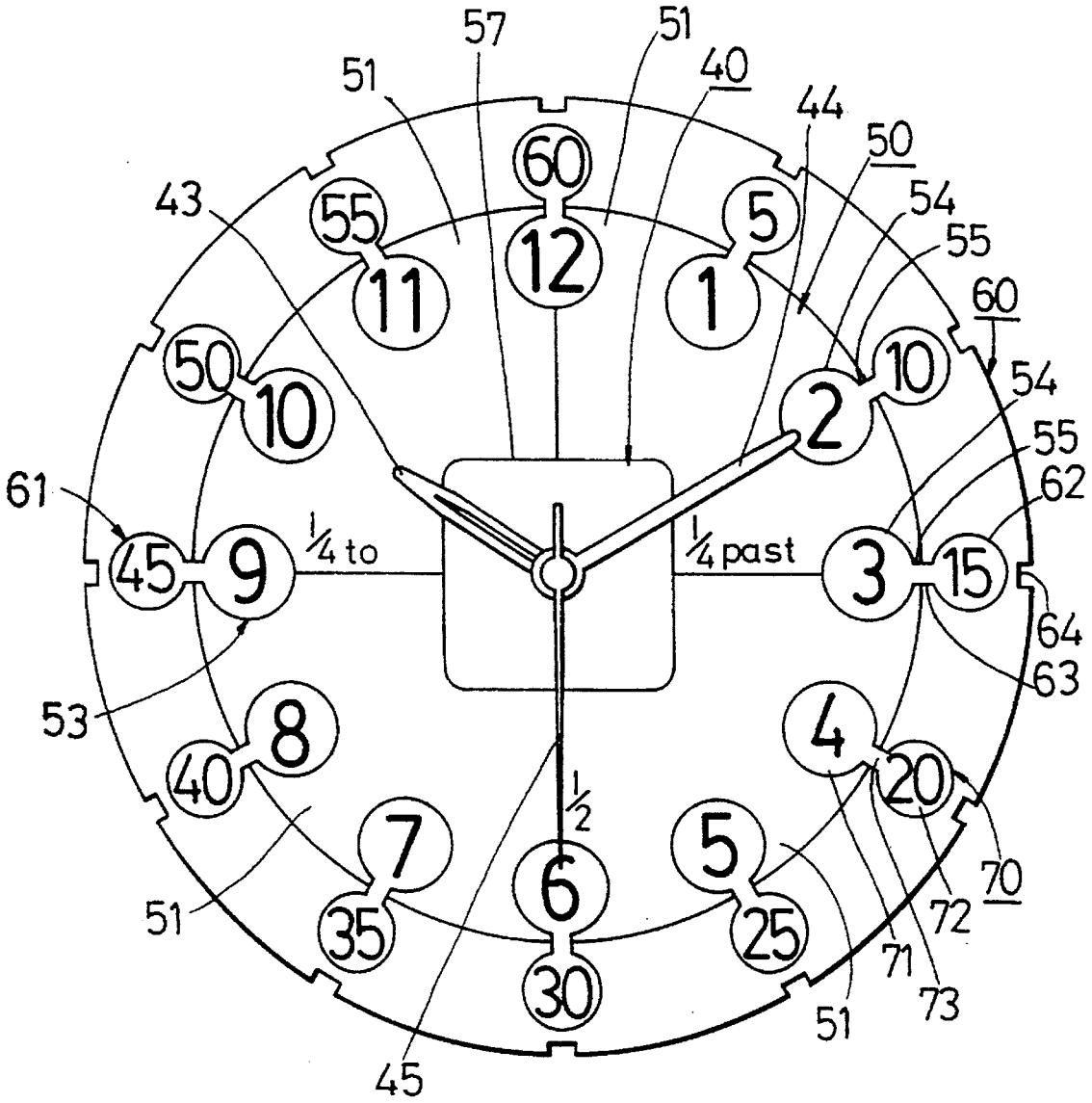
FIG. 3 is a front elevational view of the educational clock assembly of the present invention before the fix ring is disposed around the fastening ring.

The face plate 50 is formed of four modular pieces 51. Each of the modular pieces 51 is in the shape of a quarter of a circle and has a notch 52. The notches 52 cooperatively define a rectangular central receiving hole 57. The size of the central receiving hole 57 is slightly smaller than that of the casing 401 so that the clock mechanism 10 can be press-fitted firmly in the central receiving hole 57. Twelve first grooves 53 which are spaced angularly and equally on the circumference of the face plate 50 when the modular pieces 51 are combined together. Each of the first grooves 53 is formed of a bore 54 and a reduced slot 55 connected to the bore 54. In addition, three symbols "¼ pass", "½", and "¼ to" are printed respectively on the face plate adjacent to the connections of the modular piece 51, as best illustrated in FIG. 3.

The fastening ring 60 is adapted to engage around the circumference of the face plate 50 in order to bind the modular pieces 51 in position. The inner periphery 601 of the fastening ring 60 is formed with twelve second grooves 61. Each of the second grooves 61 is aligned radially with a corresponding one the first grooves 53 of the face plate 50. Each of the second grooves 61 is formed of a bore 62 and a reduced slot 63 connected to the bore 62. The slot 55 of each of the first grooves 53 is aligned and communicated with a corresponding one of the slots 63 of the second grooves 61 when the fastening ring 60 is disposed around the face plate 50.

In this embodiment, there are twelve numeral pieces 70. Each of the numeral pieces 70 is formed of a hour-piece 71, a minute-piece 72 and a connecting piece 73 which is integrally connected to the hour-piece 71 and the minute-piece 72. Each the hour-pieces 71 has a corresponding hour numeral, i.e. one of the numerals of 1, 2, 3, . . . , 12 provided thereon. Each of the minute-pieces 72 has a corresponding minute numeral, i.e. one of the numerals of 5, 10, 15, . . . , and 60 provided thereon. The hour numeral of each of the hour-pieces 71 corresponds to the minute numeral of the corresponding one of the minute-pieces 72. The outer periphery of the fastening ring 60 has a plurality of notches 64 formed therein and spaced equally from one another.

The inner diameter of the fix ring 80 is slightly smaller than the outer diameter of the fastening ring 60 so that the fix ring 80 can engage firmly around the outer periphery of the fastening ring 60. The inner periphery 81 of the fix ring 80 has a plurality of projections 82 extending radially and inwardly therefrom such that each of the notches 64 of the fastening ring 60 can engage frictionally a respective one of the projections 82 of the fix ring 80. Sixty dots 83 are spaced equally and angularly from one another on the front face of the fix ring 80, designating the minutes of an hour. The outer periphery of the fix ring 80 has a mounting member 84 for hanging purposes.

Figure 4:
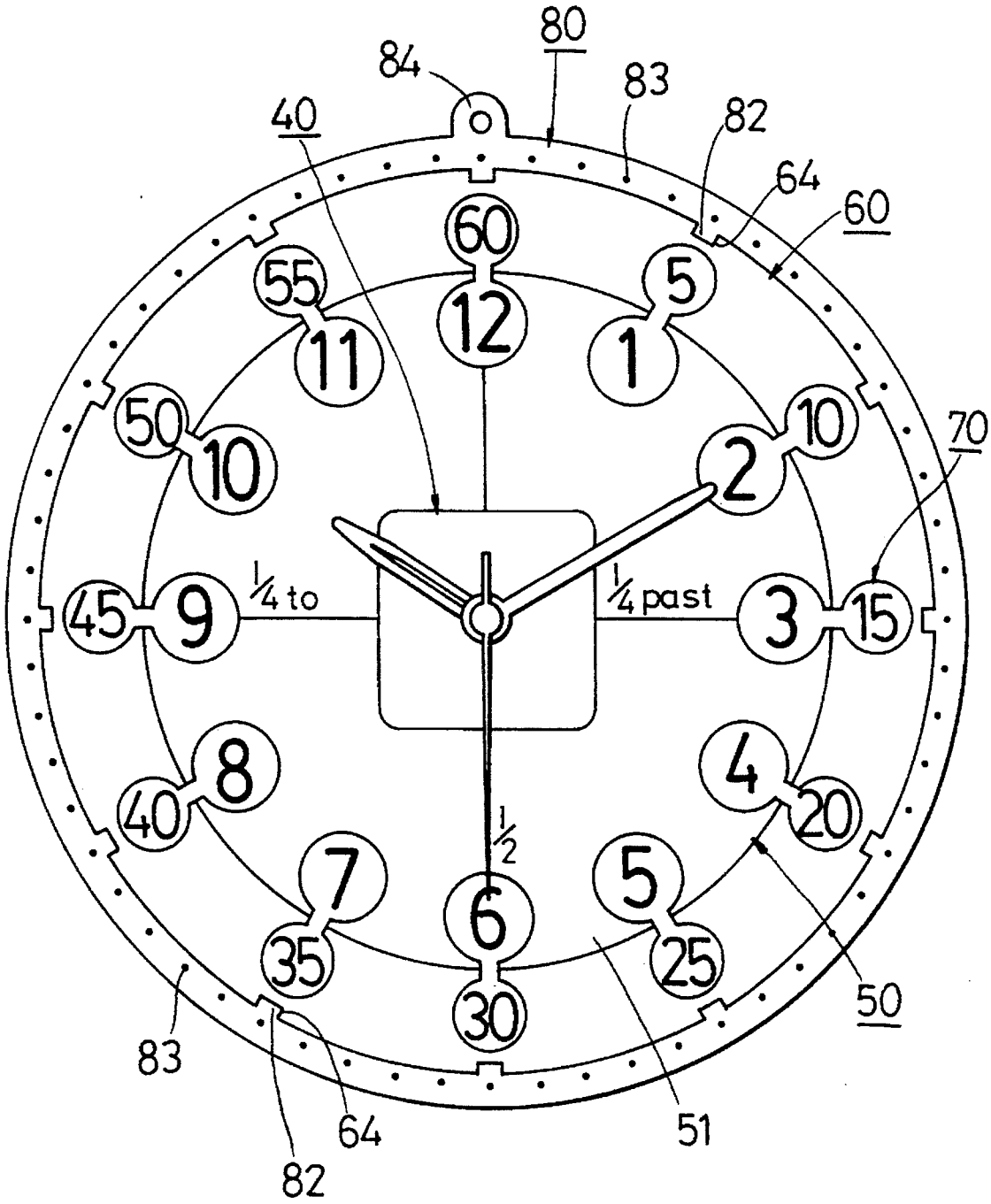
FIG. 4 is a front elevational view of the educational clock assembly of the present invention when the fix ring is disposed around the fastening ring.

With reference to FIG. 4, in assembly, the modular pieces 51 are put together in order to form the circular face plate 50. The fastening ring 60 then engages around the face plate 50. The numeral pieces 70 are mounted to the first and second grooves 53 and 61 in a proper sequence wherein each of the hour-pieces 71 is press-fitted into the respective one of the bores 54, each of the minute-pieces 72 is press-fitted into the bores 62, and each of the connecting pieces 73 is press-fitted into the slots 55 and 63 between the corresponding one of the bores 54 and the bores 62. Therefore, the engaging force of the face plate 50 and the fastening ring 60 can be enhanced. The casing 401 of the clock mechanism 40 is press-fitted into the central receiving hole 57. Finally, the fix ring 80 engages around the fastening ring 60 such that the notches 64 of the fastening ring 60 engage frictionally the projections 82 of the fix ring 80 in order to increase the overall engaging forces of the clock assembly among the clock mechanism 40, the modular pieces 51 of the face plate 50 and the fastening ring 60.

The educational clock assembly of the present invention may be used for telling the time when being hung on the wall. Alternatively, since each of the numeral pieces 70 has a hour-piece 71 and a minute-piece 72 which are connected integrally by a connecting piece 73 and which are provided with a hour numeral and a corresponding minute numeral, the educational clock assembly can be utilized in teaching the relationship between the hour and the minutes and teaching the time concepts to the children. In addition, the face plate 50, the fastening ring 60, the numeral pieces 70, and the fix ring 80 can be assembled in a proper sequence in order to enhance children's assembling ability and teach the concept of numeral sequence. Furthermore, since the face plate 50 is printed with "¼ pass", "½", and "¼ to" in a proper position, children can learn the concept of fraction and the meaning of "pass" and "to" for telling the time. It is noted that the numeral pieces 70 may have different colors which are arranged symmetrically and diametrically on the face plate 50 so that children can learn the concept of symmetry.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. An educational clock assembly, comprising:

a clock mechanism;

a circular face plate which is formed of a plurality of modular pieces, said face plate having a central receiving hole into which said clock mechanism is press-fitted, a plurality of first grooves which are spaced angularly and equally on a circumference of said face plate, each of said first grooves having a hour-piece which engages detachably therein and which bears a hour numeral;

a fastening ring engaging around said circumference of said face plate in order to bind said modular pieces together, said fastening ring having an inner periphery which has a plurality of second grooves, each of said second grooves being aligned radially with a corresponding one said first grooves of said face plate and having a minute-piece which engages detachably therein and which bears a minute numeral; and wherein each of said first and second grooves is formed of a bore for receiving a respective one of said hour-pieces and minute-pieces and a reduced slot connected to said bore, said slot of each of said first grooves being aligned and communicated with a corresponding one of said slots of said second grooves, each of said hour-pieces having a connecting piece which is connected to a corresponding one of said minute-pieces and which is inserted in said slots of said first and second grooves in order to enhance an engaging force of said face plate and said fastening ring, said hour numeral of each of said hour-pieces corresponding to said minute numeral of the corresponding one of said minute-pieces.

2. An educational clock assembly, comprising:

a clock mechanism;

a circular face plate which is formed of a plurality of modular pieces, said face plate having a central receiving hole into which said clock mechanism is press-fitted, a plurality of first grooves which are spaced angularly and equally on a circumference of said face plate, each of said first grooves having a hour-piece which engages detachably therein and which bears a hour numeral;

a fastening ring engaging around said circumference of said face plate in order to bind said modular pieces together, said fastening ring having an inner periphery which has a plurality of second grooves, each of said second grooves being aligned radially with a corresponding one said first grooves of said face plate and having a minute-piece which engages detachably therein and which bears a minute numeral; and wherein said fastening ring has an outer periphery which has a plurality of notches formed therein and spaced equally from one another, a fix ring having an inner periphery that engages around said outer periphery of said fastening ring and that has a plurality of projections extending radially and inwardly therefrom such that each of said projections of said fix ring engages frictionally a respective one of said notches of said fastening ring.

* * * * *